US011337454B2

(12) United States Patent
Figueroa et al.

(10) Patent No.: US 11,337,454 B2
(45) Date of Patent: May 24, 2022

(54) SMOKING ARTICLE WITH COMBINED VENTILATION AND FILTRATION EFFICIENCY ADJUSTMENT

(71) Applicant: PHILIP MORRIS PRODUCTS S.A., Neuchatel (CH)

(72) Inventors: Loi Mark C. Figueroa, Cabuyao Laguna (PH); Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 244 days.

(21) Appl. No.: 16/307,584

(22) PCT Filed: Jun. 27, 2017

(86) PCT No.: PCT/EP2017/065840
§ 371 (c)(1),
(2) Date: Dec. 6, 2018

(87) PCT Pub. No.: WO2018/002042
PCT Pub. Date: Jan. 4, 2018

(65) Prior Publication Data

US 2019/0343173 A1 Nov. 14, 2019

(30) Foreign Application Priority Data

Jun. 27, 2016 (EP) ..... 16176490

(51) Int. Cl.
*A24D 3/04* (2006.01)
*A24D 3/06* (2006.01)

(52) U.S. Cl.
CPC ..... *A24D 3/041* (2013.01); *A24D 3/062* (2013.01)

(58) Field of Classification Search
CPC ..... A24D 3/041; A24D 3/062
(Continued)

(56) References Cited

U.S. PATENT DOCUMENTS 3,916,914 A 11/1975 Brooks
7,878,963 B2 2/2011 Li
(Continued)

FOREIGN PATENT DOCUMENTS

CN 101442917 5/2009
CN 103796537 5/2014
(Continued)

OTHER PUBLICATIONS

Merriam Webster Dictionary, Definition of Putty, https://www.merriam-webster.com/dictionary/putty (Year: 2021).*
(Continued)

*Primary Examiner* — Kelly M Gambetta
*Assistant Examiner* — Russell E Sparks
(74) *Attorney, Agent, or Firm* — Mueting Raasch Group

(57) ABSTRACT

The invention relates to a smoking article (10) comprising a tobacco rod (12) and a filter, the filter comprising a filter unit (14) comprising a first segment (16) of filtration material; a second segment comprising a tubular element (18) of filtration material upstream of the first segment (16), the tubular element (18) having an outer diameter (D2) and an inner diameter (D1). An inner surface of the tubular element (18) is substantially air impermeable. The second segment further comprises a frangible or irreversibly collapsible flow restrictor (24) disposed in the tubular element (18). When the flow restrictor (24) is in a substantially unbroken or non-collapsed state, the filter unit (14) has a first RTD. When the flow restrictor (24) is broken or collapsed, the filter unit (14) has a second RTD, the second RTD being smaller than the first RTD.

14 Claims, 1 Drawing Sheet

Figure 1:
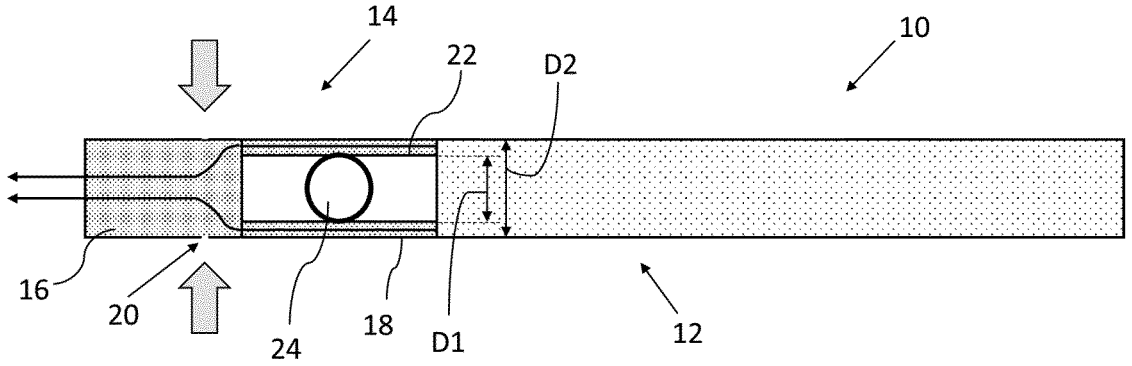

(58) Field of Classification Search
USPC ..... 131/338
See application file for complete search history.

(56) References Cited

U.S. PATENT DOCUMENTS

| | | | | |
|---|---|---|---|---|
| 8,671,951 | B2 | 3/2014 | Ercelebi | |
| 10,172,386 | B2 | 1/2019 | Besso | |
| 10,433,578 | B2 | 10/2019 | Jordil | |
| 2007/0119467 | A1 | 5/2007 | Akhmetshin | |
| 2008/0185011 | A1 | 8/2008 | Sherwood | |
| 2009/0044816 | A1 | 2/2009 | Rasouli | |
| 2013/0167851 | A1 | 7/2013 | Ademe | |
| 2014/0202478 | A1* | 7/2014 | Awty | A24D 3/048 131/332 |
| 2014/0224268 | A1 | 8/2014 | Ryter | |
| 2017/0303583 | A1 | 10/2017 | Awty | |

FOREIGN PATENT DOCUMENTS

| | | | | |
|---|---|---|---|---|
| CN | 104066344 | | 9/2014 | |
| CN | 105050435 | | 11/2015 | |
| CN | 105916393 | | 8/2016 | |
| EA | 8885 | | 8/2007 | |
| GB | 2020537 | | 11/1979 | |
| JP | 2014-516523 | | 7/2014 | |
| JP | 2015-107135 | | 6/2015 | |
| KR | 10-2013-0029053 | | 3/2013 | |
| WO | WO 2006/082529 | | 8/2006 | |
| WO | WO 2014/102095 | | 7/2014 | |
| WO | WO 2014/102096 | | 7/2014 | |
| WO | WO-2014102094 | A1 * | 7/2014 | A24D 3/045 |
| WO | WO-2014154887 | A1 * | 10/2014 | A24D 3/061 |
| WO | WO-2015007556 | A8 * | 3/2015 | B32B 1/08 |
| WO | WO 2015/101605 | | 7/2015 | |
| WO | WO 2016/087463 | | 6/2016 | |

OTHER PUBLICATIONS

European Extended Search Report for Application No. 16176490.7 dated Feb. 22, 2017.
PCT/EP2017/065840 Search Report and Written Opinion dated Aug. 16, 2017 (8 pages).
Office Action issued in Russia for Application No. 2019102020 dated Oct. 15, 2020 (14 pages).
Office Action issued in Chinese for Application No. 201780034521 dated Jan. 22, 2021 (19 pages). English translation included.
Office Action issued in Japan for Application No. 2018-566308 dated Jan. 24, 2022 (8 pages). English translation included.

* cited by examiner

SMOKING ARTICLE WITH COMBINED VENTILATION AND FILTRATION EFFICIENCY ADJUSTMENT

This application is a U.S. National Stage Application of International Application No. PCT/EP2017/065840 filed Jun. 27, 2017, which was published in English on Jan. 4, 2018, as International Publication No. WO 2018/002042 A1. International Application No. PCT/EP2017/065840 claims priority to European Application No. 16176490.7 filed Jun. 27, 2016.

The present invention relates to a smoking article including a tobacco rod and a filter.

Combustible smoking articles, such as cigarettes, generally comprise shredded tobacco (usually in cut filler form) surrounded by a paper wrapper to form a cylindrical tobacco rod and a cylindrical filter axially aligned in an abutting end-to-end relationship with the wrapped tobacco rod. The cylindrical filter typically comprises a filtration material circumscribed by a paper plug wrap. Conventionally, the wrapped tobacco rod and the filter are joined by a band of tipping paper. A cigarette is employed by a consumer by lighting one end thereof and burning the shredded tobacco rod. The consumer then receives mainstream smoke by drawing on the opposite end (mouth end or filter end) of the cigarette.

A number of smoking articles in which tobacco is heated rather than combusted have also been proposed in the art. In heated smoking articles, an aerosol is generated by heating an aerosol generating substrate, such as tobacco. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool they condense to form an aerosol that is inhaled by the consumer. Also known are smoking articles in which a nicotine-containing aerosol is generated from a tobacco material, tobacco extract or other nicotine source, without combustion and in some cases without heating, for example through a chemical reaction.

It is known to provide smoking articles with means for adjusting the level of ventilation by varying the degree of opening of one or more airflow pathways adapted to admit air into the filter. By way of example, it is known to provide a smoking article comprising a filter wherein a plug of filtration material is circumscribed by two overlying wrappers, the outer wrapper being movable relative to the inner wrapper. At least a portion of the inner wrapper is air-permeable, or a window is formed in the inner wrapper, such that a pathway for air to flow through the inner wrapper is defined. The outer wrapper is movable between a first position, wherein the outer wrapper occludes the permeable portion or window in the inner wrapper (that is, wherein the airflow pathway is restricted), and a second position wherein the permeable portion or window in the inner wrapper is at least partly exposed, (that is, wherein ambient air can be admitted into the plug of filtration material through the airflow pathway).

Adjustment of ventilation is relied upon to vary the delivery of certain combustion products, such as total particulate matter (TPM), tar and carbon monoxide, since by admitting into the filter more ambient air the mainstream smoke drawn by the consumer can be diluted to a greater extent. However, higher levels of ventilation are typically associated with significantly lower levels of resistance to draw (RTD), which may not be desirable for the consumer.

Flow restrictors have been provided in smoking articles to compensate for a low RTD. Flow restrictor elements may for example be embedded in a plug or tube of filtration material. Further, filter segments including a flow restrictor element may be combined with other filter segments, which may optionally include other additives, such as sorbents or flavourants. This may apply to both combustible smoking articles and to smoking articles in which tobacco is heated.

A need persists in improving features and functions of a filtered smoking article with a view to enhancing usability and facilitating a personalised user's experience. In particular, it would be desirable to provide a novel and improved filtered smoking article such that the consumer can selectively adjust the taste, which is determined in part by the delivery of certain combustion products, such as tar. It would be particularly desirable to provide one such filtered smoking article wherein one such adjustment is achieved without altering the degree of opening of any airflow pathways adapted to admit ambient air into the filter. In addition, it would be desirable to provide one such filtered smoking article that can easily be manufactured without requiring any major modification to existing equipment.

According to the present invention, there is provided a smoking article comprising a tobacco rod and a filter comprising a filter unit. The filter unit comprises a first segment of filtration material and a second segment comprising a tubular element of filtration material upstream of the first segment, the tubular element having an outer diameter (D2) and an inner diameter (D1). An inner surface of the tubular element is substantially air impermeable. Further, the second segment comprises a frangible or irreversibly collapsible flow restrictor disposed within the tubular element, the flow restrictor being breakable or irreversibly deformable upon application of a load on the filter. When the flow restrictor is in a substantially unbroken state, the filter unit has a first RTD. When the flow restrictor is broken, the filter unit has a second RTD, the second RTD being smaller than the first RTD. In contrast to known filtered smoking articles, in accordance with the present invention the filter comprises a filter unit comprising a first segment of filtration material and a second segment comprising a tubular element of filtration material upstream of the first segment, wherein an inner surface of the tubular element is substantially air impermeable. Further, the second segment comprises a frangible flow restrictor within a cavity internally defined by the tubular element, such that the consumer can break the flow restrictor by applying a load, for example a compressive load, on the filter.

When intact, the flow restrictor occludes at least partly the channel internally defined by the tubular element. As will be explained in more detail below, a transverse cross-sectional surface area of the flow restrictor at its widest point may, for example, be at least 70 percent of the theoretical free cross section of the tubular element. Because the flow restrictor is substantially gas-impervious, the flow of mainstream smoke drawn into the filter from the tobacco rod is diverted, for the most part, to flow through the periphery of the tubular element. Accordingly, under such conditions, the filter unit has a first RTD, which corresponds to a combination of the RTD of the second segment and the RTD of the first segment. The second segment has an RTD which is a combination of the RTD of the peripheral filtration material in the tubular element and the RTD of the at least partially occluded channel, which are effectively arranged in parallel.

In addition, where the smoking article comprises a ventilation zone at a location along the first segment, and thus downstream of the flow restrictor, a higher pressure drop across the tubular element results in a greater amount of ventilation air being drawn in downstream of the tubular element and towards the consumer's mouth. Thus, a first smoking article configuration combining high RTD values and high ventilation is provided to the consumer.

When the consumer applies a sufficiently great load on the filter, the flow restrictor breaks into smaller fragments or collapses irreversibly, such that at least a part of the cross section of the tubular element previously occluded by the unbroken or non-collapsed flow restrictor becomes free for the smoke to flow through. Thus, the incoming mainstream smoke will, for the most part, flow across the tubular element through its central channel to reach the first segment. By contrast, the fraction of incoming mainstream smoke effectively flowing through the peripheral filtration material of the tubular element defining the second segment of the filter unit is reduced substantially. Therefore, the filter unit has a second, reduced RTD which corresponds essentially to the RTD of the first segment of filtration material alone, the RTD of the second segment having been reduced to a negligible value.

Further, under such circumstances, where the smoking article comprises a ventilation zone at a location along the first segment, the reduced pressure drop across the tubular element results in a decreased amount of ventilation air being drawn into the filter and towards the consumer's mouth. Accordingly, a second smoking article configuration associated with low RTD values and low ventilation is provided for the consumer.

Smoking articles in accordance with the present invention make it easy for the consumer to select one smoking regime or the other, such that the consumer may effectively adjust the delivery of tar (as it is impacted by ventilation) as well as the RTD of the smoking article. This is advantageously achieved without requiring the consumer to precisely move and adjust the relative position of movable elements of the smoking article, as is the case in embodiments known in the art.

In general, levels of tar delivery of up to 5 milligrams are considered, in the art, to be "low", whereas levels of tar deliver higher than 5 milligrams are typically regarded as being "high". In a smoking article in accordance with the present invention, when the flow restrictor is in an unbroken or non-collapsed state, the levels of tar delivery will typically be lower than when the flow restrictor has been broken or irreversibly collapsed. Thus, in the context of the present specification, the configuration wherein the flow restrictor is unbroken or non-collapsed may at times be described as "low tar configuration", whereas the configuration wherein the flow restrictor is broken or irreversibly collapsed may be referred to as "high tar configuration". However, in this context, the terms "high tar" and low tar" are not to be construed with reference to the 5 milligrams threshold referred to above, but rather as an indication of a difference in tar delivery between the two configurations. Thus, in some embodiments, smoking articles according to the present invention may have tar delivery levels below 5 milligrams (that is, levels of tar delivery that would commonly be labelled as "low" in the art) in both configurations. In other embodiments, smoking articles according to the present invention may have tar delivery levels above 5 milligrams (that is, levels of tar delivery that would commonly be labelled as "high" in the art) in both configurations.

The application of a small compressive load onto the filter is enough for the consumer to obtain the desired configuration. Further, the consumer may choose to break the restrictor before lighting the smoking article or at any time during smoking, which provides for a further personalisation of the smoking article, the features of which may easily be tailored to the consumer's preferences.

In addition, smoking articles according to the present invention are easy to manufacture and do not require any extensive modification of the existing apparatus.

The terms "upstream" and "downstream" are used herein to describe relative positions between elements of the filter or smoking article in relation to the direction of mainstream smoke as it is drawn from a lit end of the smoking article through the filter.

As used herein, the term "longitudinal" is used to describe the direction between the downstream or proximal end and the opposed upstream or distal end and the term "transverse" is used to describe the direction perpendicular to the longitudinal direction.

The term "frangible" is used throughout this specification to describe a material or component that tends to break up into a plurality of smaller fragments upon application of a load, for example a compressive load, as opposed to other materials and components which are adapted to deform elastically and retain their cohesion as single objects. By way of example, the frangible flow restrictor may be provided as a frangible membrane extending across at least part of the free cross-section of the tubular element. As an alternative, the frangible flow restrictor may be a flavourless breakable capsule. One such capsule does not contain any payload or additive capable of altering the taste of the mainstream smoke, but it may contain air. As one further alternative, the frangible flow restrictor may be provided as a brittle aggregate of smaller particles bound together by means of a binder. By adjusting parameters such as the size of the smaller particles or the nature and amount of binder or a combination thereof, it is possible to tailor the resistance to compression of one such flow restrictor, as well as to ensure that the flow restrictor breaks into sufficiently small particles that their impact on the RTD of the second segment of the filter unit is negligible.

The term "collapsible" is used throughout this specification to describe a material or component that tends to collapse irreversibly upon application of a load, such as a compressive load, as opposed to other materials and components which are adapted to deform elastically and regain their original shape and size. By way of example, a collapsible flow restrictor may be made of an open- or closed-cell, brittle, non-elastic foam material that has no shape memory and so, when compressed, collapses irreversibly. As a further alternative, a collapsible flow restrictor may be made of an irreversibly deformable material like wax or a putty-like polymeric material. As used herein, the term "resistance to draw" (RTD) refers to the pressure required to force air through the full length of the object under test at the rate of 17.5 millilitres/second at 22 degrees Celsius and 101 kPa (760 Torr). It is typically expressed in units of millimetres water gauge (mmWG) and is measured in accordance with ISO 6565:2011.

The term "ventilation level" refers to the percentage by volume of air that is included in the smoke delivered to the consumer from the mouth end of the filter with the ventilation completely open. The level of ventilation achieved by the ventilation elements can be determined using ISO test method 9512:2002.

The expression "transverse cross-sectional surface area of an object (such as the flow restrictor) at its widest point" refers to the maximum cross-sectional surface area of the object as measured in a plane transverse to the longitudinal direction of the filter or smoking article. By way of example, for an ovoid-shaped or ellipsoid-shaped object arranged with the major axis (A) extending substantially parallel to the longitudinal axis of the filter, the transverse cross-section will generally have an elliptic shape and, at the widest point of the object, a surface area $S=\pi \cdot B \cdot C$, where B and C are the lengths of the minor axes of the ellipsoid. Where the flow restrictor is a sphere having radius R, a transverse cross-sectional area S of the flow restrictor at its widest will be essentially $S=\pi \cdot R^2$.

The expression "theoretical free cross-section of the tubular element" refers to the internal cross-section of the tubular element, all of which would be available for gas flow if no restrictor, intact or broken up into fragments, were present in the tubular element. Thus, where the tubular element has an inner diameter D1, the theoretical free cross-section of the tubular element is substantially equal to $\pi/4 \cdot (D1^2)$. The term "gas permeability" is used herein to describe the tendency of a given material to allow permeation, that is, the diffusion of molecules of a gas or of a gaseous mixture (the permeant) through the material. Permeation works through diffusion, therefore the permeant will move under a concentration gradient. Permeability is measured in units of area, commonly in squared metres. The terms "air-impermeable" and "gas-impermeable" are used to describe a material not allowing the passage of fluids, particularly air and smoke, through interstices or pores in the material. If the flow restrictor comprises a material impermeable to air and smoke, air and smoke drawn through the filter are forced to flow through a reduced cross section of filtration material. Thus, the flow restrictor reduces the permeable cross-sectional area of the filter.

The term "compressive yield strength" is used throughout this specification to describe the capacity of a material or component used in a smoking article to withstand loads tending to reduce size. In other words, the "compressive yield strength" resists compression. By definition, the ultimate compressive strength of a material or component is that value of uniaxial compressive stress reached when the material or component fails completely. The compressive strength of a material or component is usually assessed experimentally by means of a compressive test. Upon application of a uniaxial compressive load, the specimen (usually cylindrical) is shortened as well as spread laterally until it breaks. In more detail, in the present specification, the term "compressive strength" refers to the value of uniaxial compressive stress reached when there is an irreversible deformation or collapse of the flow restrictor.

The compressive yield strength may be determined experimentally by means of standardized test ISO 604. In the test, the specimen (for example, the flow restrictor) is compressed by compressive plates along an axis that corresponds to the direction along which a smoker's fingers would exert pressure on the flow restrictor when the smoker is grasping the smoking article. During the test, the plates are displaced at a constant rate until the load or deformation reaches a predetermined value. The load sustained by the specimen (flow restrictor) is measured during the procedure.

If the test is carried out on the flow restrictor alone and not on the flow restrictor arranged within the tubular element, the measured value of compressive yield strength will depend on the shape and properties of the material from which the flow restrictor is made and will not be impacted by the properties of the tubular element. In the present specification, the term "inherent compressive strength" is used to refer to values of compressive strength measured on the flow restrictor alone.

Similar measurements may, however, also be carried out on the tubular element of filtration material with the flow restrictor arranged within the tubular element. Without wishing to be bound to theory, it will be understood that under such conditions the measured value of the compressive strength will depend on a combination of the shape and properties of the material from which the flow restrictor is made as well as on the properties of the tubular element, such as the composition of the filtration material, the thickness of the wall of the tubular element, and so forth. In the present specification, the term "compressive strength of the second segment" refers to values of compressive strength measured under such conditions.

While the test is aimed at determining the value of a substantially uniaxial compressive load capable of breaking up the flow restrictor, is should be understood that, in use, the consumer may apply on the flow restrictor arranged within the tubular element a load that is not necessarily purely compressive or uniaxial, such as for example the load that may be applied on the flow restrictor if the consumer twists the tubular element. Smoking articles according to the invention comprise a tobacco rod and a filter connected to the tobacco rod. As an alternative, the tobacco rod may be replaced by another tobacco-containing substrate capable of generating an aerosol.

The filter comprises a filter unit that comprises a first segment of filtration material and a second segment comprising a tubular element comprising filtration material upstream of the first segment. Filtration material may comprise any suitable material or materials. Examples of suitable materials include cellulose acetate, PLA fibres, viscose fibres, crimped paper or combination thereof. Due to the localised compaction of the filter material around the restrictor, a low-density filtration medium might be preferred.

The filter preferably has an overall length of at least about 15 millimetres. More preferably, the filter has an overall length of at least about 18 millimetres. In addition, or as an alternative, the filter has preferably an overall length of less than about 40 millimetres, more preferably less than about 35 millimetres. In one embodiment, the filter has an overall length of about 27 millimetres.

The first filter segment of filtration material preferably has a length of at least about 9 millimetres, more preferably at least about 11 millimetres. In addition, or as an alternative, the first filter segment of filtration material preferably has a length of less than about 15 millimetres, more preferably less than about 12 millimetres.

The tubular element defining the second segment preferably has a length of at least about 5 millimetres, more preferably at least about 10 millimetres. At the very least, the tubular element has a length sufficient to receive the flow restrictor. In addition, or as an alternative, the tubular element preferably has a length of less than about 30 millimetres, more preferably less than 20 millimetres. In a preferred embodiment, the tubular element has a length of about 15 millimetres.

Preferably, in the second segment the tubular element comprises a hollow tube defining the inner surface of the tubular element and the filtration material is arranged about the hollow tube.

The hollow tube may comprise any material or materials including, but not limited, to paper, cardboard, filter material for example cellulose acetate, any thermoplastic, starch, polylactic acid, polyvinyl alcohol, poly(butylene succinate) and its copolymers, poly(butylene adipate-co-terephthalate) and combinations thereof.

The outer diameter (D2) of the tubular element defining the second segment of the filter unit will generally greatly contribute to defining the overall diameter of the filter unit and of the smoking article. This is because the filter will typically comprise a filter wrapper circumscribing the filter unit and any further optional filter segment, and tipping paper will be used to attach the filter to the tobacco rod. However, the thickness of the filter wrapper and tipping paper will not in general add significantly to the overall diameter of the filter and of the smoking article. Accordingly, the outer diameter of the second segment may typically be from about 5 millimetres to about 8.5 millimetres, preferably from about 5.4 millimetres to about 8.1 millimetres.

On the other hand, the inner diameter (D1) of the tubular element defining the second segment of the filter unit may be adjusted to tailor other characteristics of smoking articles according to the invention. Preferably, the inner diameter (D1) is at least about 70 percent of the outer diameter (D2), more preferably at least about 80 percent of the outer diameter (D2).

Without wishing to be bound to theory, it will be understood that by varying the thickness and density of the peripheral filtration material of the tubular element, it is possible to adjust the first RTD of the filter unit, that is, the RTD provided when the flow restrictor is in an unbroken or non-collapsed state. At the same time, a thicker peripheral layer of filtration material will impact the compressive strength of the second segment. Thus, smoking articles in accordance with the present invention may advantageously provide a particularly broad spectrum of design alternatives, such that several parameters of the smoking article can be conveniently tailored.

The hollow tube and the filtration material arranged about the hollow tube may be overwrapped with a filter wrapper. A filter wrapper provides strength and structural rigidity for the tubular element. The filter wrapper may comprise any suitable material. In dome embodiments, the filter wrapper is a stiff plug wrap, for example comprising stiff paper or cardboard. The stiff paper or cardboard preferably has a basis weight greater than about 60 grams per square metre. One such stiff filter wrapper provides high structural rigidity. The filter wrapper may prevent deformation on the outside of the tubular element at the location where the flow restrictor is embedded within the tubular element.

In some embodiments, the filter may comprise one or more additional segments, which may be arranged upstream or further downstream of the tubular element.

In preferred embodiments, the first filter segment and the tubular element are aligned and in substantially abutting arrangement. However, in some embodiments the first filter segment and the tubular element may as an alternative be spaced from one another. This may be achieved by providing a gap between the first filter segment and the tubular element, the gap thus defining a cavity within the filter, or by providing a further filter segment, such as a segment of filtration material, arranged between the first filter segment and the tubular element. A frangible or irreversibly collapsible flow restrictor is disposed within the tubular element. The flow restrictor can be broken or collapsed irreversibly upon application of a load on the filter, such that, when the flow restrictor is in a substantially unbroken state, the filter unit has a first RTD, and when the flow restrictor is broken, the filter unit has a second RTD smaller than the first RTD.

Preferably, the first RTD is at least about 120 millimetres water gauge. More preferably, the first RTD is at least about 130 millimetres water gauge. Even more preferably, the first RTD is at least about 140 millimetres water gauge. In addition, or as an alternative, the first RTD is preferably less than about 190 millimetres water gauge. More preferably, the first RTD is less than about 180 millimetres water gauge. Even more preferably, the first RTD is less than about 170 millimetres water gauge. In some preferred embodiments, the first RTD is from about 120 millimetres water gauge to about 190 millimetres water gauge.

Preferably, the second RTD is at least about 50 millimetres water gauge. More preferably, the second RTD is at least about 60 millimetres water gauge. Even more preferably, the second RTD is at least about 70 millimetres water gauge. In addition, or as an alternative, the second RTD is preferably less than about 100 millimetres water gauge. More preferably, the second RTD is less than about 90 millimetres water gauge. Even more preferably, the second RTD is less than about 80 millimetres water gauge. In some preferred embodiments, the second RTD is from about 50 millimetres water gauge to about 100 millimetres water gauge.

Preferably, a difference between the first RTD and the second RTD is at least about 20 millimetres water gauge. More preferably, a difference about the first RTD and the second RTD is at least about 40 millimetres water gauge. Even more preferably, a difference between the first RTD and the second RTD is at least about 60 millimetres water gauge.

A transverse cross-sectional surface area of the flow restrictor is at least about 70 percent of the theoretical free cross section of the hollow tube (that is, $\pi/4$ times the square of the inner diameter D1). Preferably, the transverse cross-sectional surface area of the flow restrictor is at least about 80 percent of the theoretical free cross section of the hollow tube. Even more preferably, the transverse cross-sectional surface area of the flow restrictor is at least about 95 percent of the theoretical free cross section of the hollow tube. In some preferred embodiments, the transverse cross-sectional surface area of the flow restrictor is substantially 100 percent of the theoretical free cross section of the hollow tube, such that the flow restrictor occludes the channel defined by the hollow tube substantially in its entirety, all the mainstream smoke being thus forced to flow across the second segment through the filtration material at the periphery of the second segment.

In preferred embodiments, at least one cross-sectional dimension of the flow restrictor is at least about as large as the inner diameter of the tubular element, such that the flow restrictor engages with the hollow tube to retain the flow restrictor in the tubular element. In practice, the flow restrictor is shaped and sized so that it is wedged within the tubular element. This is advantageous so that the restrictor occupies a predefined location within the tubular element, which makes it easy for the consumer to break the restrictor, if he or she so wishes. This is also advantageous in that one such flow restrictor is substantially wedged in the hollow tube and so cannot move, which makes it easier for the consumer to break it or cause it to collapse when applying a load on the filter.

The flow restrictor is made of a frangible or irreversibly collapsible material. Thus, when the restrictor is broken or caused to collapse, the theoretical free cross-sectional area of the tubular element is at least partly and irreversibly restored.

Preferably, the flow restrictor has an inherent compressive yield strength of less than about 20 Newtons. More preferably, the flow restrictor has an inherent compressive yield strength of less than about 18 Newtons. In addition, or as an alternative, the flow restrictor has an inherent compressive yield strength of at least about 10 Newtons. More preferably, the flow restrictor has an inherent compressive yield strength at least about 14 Newtons. In preferred embodiments, the flow restrictor has an inherent compressive yield strength from about 10 Newtons to about 20 Newtons.

These values are particularly preferred for frangible flow restrictors that comprise a hollow, breakable shell. It will be understood that flow restrictors formed from alternative materials such as wax-like or putty-like polymeric material may require lower loads to be collapsed. In general, it is advantageous that the flow restrictor has a compressive yield strength great enough for the flow restrictor to not break during normal handling of the smoking article, and small enough that it is easy to break for the consumer during use. Inherent compressive yield strength values of at least about 10 Newtons are advantageous in that it is less likely for the flow restrictor to be damaged or broken during the manufacturing of the smoking article.

Preferably, the compressive strength of the second segment is less than about 45 Newtons. In addition, or as an alternative, the compressive strength of the second segment is at least about 40 Newtons. In particular, it is easy to ensure that the flow restrictor is at a predetermined distance from the mouth end of the smoking article. Preferably, the flow restrictor is at least 10 mm from the mouth end of the smoking article, more preferably at least 15 mm from the mouth end of the smoking article.

In preferred embodiments, the restrictor is substantially spherical. However, alternative shapes are also possible. The restrictor may, for example, be substantially cylindrical or be provided as a membrane. In particular, the restrictor may be provided as a membrane extending in a plane perpendicular to a longitudinal axis of the tubular element.

In some embodiments, the restrictor is hollow. In practice, the restrictor may be provided as an empty shell, which is advantageous in that it is generally easy to break by applying a compressive load from outside the tubular element. In these embodiments, the restrictor does not contain any additive or payload capable of impacting the properties of the mainstream smoke, such as the taste. Thus, in particular, the restrictor is flavourless and contains no flavourant. However, a hollow restrictor may contain air. Further, it may be desirable that a hollow restrictor contain a liquid, preferably a viscous liquid, such that, when the restrictor is broken and the liquid is released, the fragments into which the restrictor breaks can stick to the inner surface of the tubular element.

In alternative designs, the restrictor may be an aggregate of smaller particles (for example, granules held together by a binder). It is desirable that one such aggregate be brittle, so that it is easy for the consumer to break the restrictor into fine particles. Preferably, one such aggregate breaks into particles so small that they can scatter within the tubular element whilst being substantially non obstructive.

Preferably, smoking articles according to the present invention comprise a ventilation zone at a location along the first filter segment. Thus, the ventilation zone is at a location downstream of the flow restrictor. The ventilation zone will be provided as a row or rows of perforations through the tipping paper/filter wrapper and allowing ambient air to be drawn into the first segment. Preferably, the ventilation zone is located at least about 9 millimetres from the mouth end of the smoking article. More preferably, the ventilation zone is located at least about 10 millimetres from the mouth end of the smoking article.

By adjusting the number and size of the ventilation holes, it is possible to tailor the amount of ventilation air admitted into the filter when the user draws on the smoking article. For example, one or two rows of ventilation holes may be formed through the tipping paper/filter wrapper to define the ventilation zone. This is advantageous in that, as explained above, different combinations of RTD and ventilation values may result in different levels of tar delivery, and so smoking articles in accordance with the present invention offer a broader spectrum of design options.

Preferably, when the flow restrictor is in a substantially unbroken or non-collapsed state, smoking articles according to the present invention have a ventilation level of at least about 40 percent, more preferably at least about 45 percent, even more preferably at least about 50 percent. In addition, or as an alternative, when the flow restrictor is in a substantially unbroken or non-collapsed state, smoking articles according to the present invention have a ventilation level of less than about 85 percent, more preferably less than about 80 percent, even more preferably less than about 75 percent. In preferred embodiments, when the flow restrictor is in a substantially unbroken or non-collapsed state a ventilation level of the smoking article is from about 40 percent to about 85 percent.

When the flow restrictor is broken or irreversibly collapsed upon application of a load on the part of the consumer, the reduced pressure drop across the tubular element results in a decrease of the amount of ventilation air drawn into the filter and towards the consumer's mouth. Preferably, when the flow restrictor is broken or collapsed, smoking articles according to the present invention have a ventilation level of at least about 20 percent, more preferably at least about 25 percent. In addition, or as an alternative, when the flow restrictor is broken or collapsed, smoking articles according to the present invention have a ventilation level of less than about 40 percent, more preferably less than about 35 percent. In preferred embodiments, when the flow restrictor is broken or collapsed, a ventilation level of the smoking article is from about 20 percent to about 40 percent. In some embodiments, the tubular element comprises a layer of a substantially air impermeable material applied on the inner surface of the tubular element.

Figure 2:
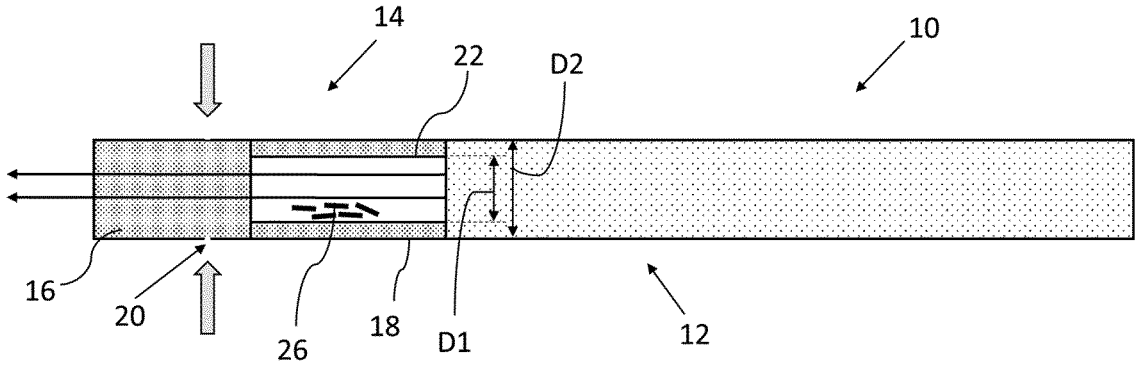

The invention will now be further described, by way of example only, with reference to the accompanying drawings in which:

FIG. 1 is a schematic sectional view of a smoking article in accordance with the present invention in a first configuration; and FIG. 2 a schematic sectional view of the smoking article of FIG. 1 in a second configuration.

FIG. 1 shows a smoking article 10 in accordance with the present invention. The smoking article 10 comprising a tobacco rod 12 and a filter unit 14. The filter unit 14 is in alignment and in abutting arrangement with the tobacco rod 12.

The filter unit 14 comprises a first segment 16 of filtration material having a length of about 15 millimetres and a second segment comprising a tubular element 18 of filtration material having a length of about 12 millimetres and arranged upstream of the first segment 16. The first segment 16 and the tubular element 18 are substantially aligned and in abutting relationship. The smoking article 10 further comprises a ventilation zone 20 at a location along the first filter segment 14.

The tubular element 18 has an outer diameter D2 of about 7.8 mm and an inner diameter D1 of about 5 mm. In more detail, the tubular element 18 comprises a hollow paper tube 22 circumscribed by a layer of filtration material. An inner surface of the tubular element 18 is substantially air impermeable.

Further, the filter unit 14 comprises a flow restrictor 24 disposed within the paper tube 22 at a location along the tubular element 18. The flow restrictor is spherical and has a diameter of about 4.2 millimetres. Thus, A transverse cross-sectional surface area of the flow restrictor 24 is about 70 percent of the free cross section of the hollow tube 22.

In the embodiment of FIG. 1, the flow restrictor 24 is substantially spherical and has a diameter that is slightly less than the inner diameter D1 of the tubular element. Accordingly, the greater part of the mainstream smoke reaching the filter progresses through to the first filter segment 12 by flowing through the filtration material disposed about the hollow tube 22 (as indicated by arrows in FIG. 1). Accordingly, in the configuration illustrated in FIG. 1, the smoking article 10 provides high RTD values and high ventilation (as depicted by the block arrows in FIG. 1), due to a higher pressure drop across the tubular element.

The flow restrictor 24 is frangible. Thus, upon application of a load greater than its inherent compressive yield strength the flow restrictor 24 breaks up into fragments 26, as illustrated in FIG. 2. Accordingly, at least part of the cross section of the hollow tube 22 previously occluded by the unbroken flow restrictor 24 becomes available for gas flow. Thus, the incoming mainstream smoke will tend, for the most part, to flow across the second segment through its hollow core to reach the first segment (as illustrated by arrows in FIG. 2). Therefore, the overall RTD of the smoking article corresponds essentially to the RTD of the first segment 14 alone. Under such circumstances, the reduced pressure drop across the hollow tube 22 results in a decreased amount of ventilation air being drawn into the filter and towards the consumer's mouth. Accordingly, a second smoking article configuration associated with low RTD values and low ventilation (as depicted by the block arrows in FIG. 2) is provided for the consumer.

Tables 1 and 2 below contain parameters measured on the smoking article described above with reference to FIGS. 1 and 2 in the first configuration (that is, with the flow restrictor intact), and in the second configuration (that is, after breaking the flow restrictor), respectively. In the second configuration, an increase in the tar delivery is also observed.

TABLE 1

| | RTD | Ventilation |
|---|---|---|
| Average | 150.8 | 51.3 |
| Standard deviation | 16.20 | 8.71 |

TABLE 2

| | RTD | Ventilation |
|---|---|---|
| Average | 73.7 | 23.0 |
| Standard deviation | 6.76 | 6.09 |

The invention claimed is:

1. A smoking article comprising a tobacco rod and a filter, the filter comprising a filter unit comprising:

a first segment of filtration material;

a second segment comprising a tubular element of filtration material upstream of the first segment, the tubular element having an outer diameter (D2) and an inner diameter (D1), an inner surface of the tubular element being substantially air impermeable; the second segment further comprising an irreversibly collapsible flow restrictor disposed within the tubular element, the flow restrictor being collapsible upon application of a load on the filter;

wherein the inner diameter (D1) is at least about 70 percent of the outer diameter (D2);

wherein, when the flow restrictor is in a substantially non-collapsed state, the filter unit has a first RTD; and, when the flow restrictor is collapsed, the filter unit has a second RTD, the second RTD being smaller than the first RTD;

wherein the collapsible flow restrictor is made of an open- or closed-cell, non-elastic foam material that has no shape memory or of an irreversibly deformable wax or polymeric material.

2. The smoking article according to claim 1, wherein the tubular element comprises a hollow tube defining the inner surface of the tubular element and the filtration material is arranged about the hollow tube.

3. The smoking article according to claim 1, wherein the flow restrictor has an inherent compressive yield strength of less than about 20 Newtons.

4. The smoking article according to claim 1, wherein the flow restrictor has an inherent compressive yield strength of at least about 10 Newtons.

5. The smoking article according to claim 1, wherein a compressive yield strength of the second segment is less than about 45 Newtons.

6. The smoking article according to claim 1, wherein the first RTD is at least about 120 millimetres water gauge.

7. The smoking article according to claim 1, wherein the second RTD is less than about 100 millimetres water gauge.

8. The smoking article according to claim 1, wherein a transverse cross-sectional surface area of the flow restrictor is at least about 70 percent of a theoretical free cross section of the tubular element.

9. The smoking article according to claim 1, wherein at least one cross-sectional dimension of the flow restrictor is at least about as large as the inner diameter (D1) of the tubular element, such that the flow restrictor engages with the tubular element to retain the flow restrictor in the tubular element.

10. The smoking article according to claim 1, wherein the at least one cross sectional dimension of the flow restrictor, measured in a transverse direction of the filter, is substantially equal to the inner diameter (D1) of the tubular element.

11. The smoking article according to claim 1, wherein the flow restrictor is substantially spherical.

12. The smoking article claim 1, comprising a ventilation zone at a location along the first filter segment.

13. The smoking article according to claim 12 wherein, when the flow restrictor is in a substantially unbroken or non-collapsed state, a ventilation level of the smoking article is at least about 40 percent.

14. The smoking article according to claim 1, wherein the inner surface of the tubular element is defined by a layer of a substantially air impermeable coating material.

* * * * *